US005325966A

United States Patent [19]

Chang

[11] Patent Number: 5,325,966

[45] Date of Patent: Jul. 5, 1994

[54] TOOL BOX

[76] Inventor: Fu-Ping Chang, No. 7, Ta Chih Lane, Hsueh Fu Rd., Ta Ya Hsiang, Taichung Hsien, Taiwan

[21] Appl. No.: 72,054

[22] Filed: Jun. 2, 1993

[51] Int. Cl.[5] ..... B65D 21/02

[52] U.S. Cl. ..... 206/372; 206/349; 206/509; 220/4.24; 220/4.27

[58] Field of Search ..... 206/372, 373, 509, 349; 220/4.21, 4.24, 4.26, 4.27

[56] References Cited

U.S. PATENT DOCUMENTS

| | | | |
|---|---|---|---|
| 3,182,856 | 5/1965 | Goltz | 220/4.27 |
| 3,565,146 | 2/1971 | Arnold | 220/4.24 |
| 4,951,812 | 8/1990 | Chen | 206/373 |
| 4,998,616 | 3/1991 | Hillinger | 206/372 |
| 5,036,980 | 8/1991 | Vigue et al. | 220/4.24 |
| 5,040,681 | 8/1991 | Grusin | 206/372 |
| 5,060,851 | 10/1991 | Lorenz | 220/4.24 |
| 5,117,979 | 6/1992 | Brightbill | 206/373 |

FOREIGN PATENT DOCUMENTS

| | | | |
|---|---|---|---|
| 0477064 | 7/1975 | U.S.S.R. | 220/4.24 |

*Primary Examiner*—Jimmy G. Foster
*Attorney, Agent, or Firm*—Bacon & Thomas

[57] ABSTRACT

A tool box having (a) a first half having two first recesses formed therein, two anchors formed in the first recesses, two second recesses formed therein and two pairs of claws formed in the second recess and (b) a second half having two first recesses formed therein, two anchors formed in the first recesses, two second recesses formed therein and two pairs of claws formed in the second recess. The pairs of claws formed on the first half are insertable in the first recesses formed in the second half while the pairs of claws formed on the second half are insertable in the first recesses formed in the first half. The first half is then slidable relative to the second half so that the anchors and the pairs of claws formed on the first half respectively engage with the pairs of claws and the anchors formed on the second half. The first half is restrained from traveling relative to the second half in a direction being perpendicular to the first and second halves.

2 Claims, 7 Drawing Sheets

TOOL BOX

BACKGROUND OF INVENTION

1. Field of Invention

The present invention relates to a tool box.

1. Related Prior Art

One type of conventional tool box has two separate halves which are joined together by means of two pivots and are locked to each other by means of two buckles. This type of tool box is structurally complicated as each half requires two connections through which the pivots are insertable, and one half has two buckle-mounting portions on which the buckles are mounted and the remaining half is formed with two traps on which the buckles can be trapped. It is difficult to assemble this type of tool box because the pivots must be inserted through the connections and the buckles must be mounted on the buckle-mounting portions.

Another type of conventional tool box is one-piece member which has two integral halves. The halves are molded together with a strip-shaped connection. One half is molded together with a number of buckles and the remaining half is molded together with a corresponding number of traps. A whole tool box having two halves must be disposed of even if some defects are formed in only one of the halves thereof.

Therefore, the present invention is intended to solve the above-mentioned problems.

SUMMARY OF INVENTION

It is an object of the present invention to provide a tool box having two separate halves which can be joined together without pivots.

It is another object of the present invention to provide a tool box having two separate halves which can be fitted to each other without buckles.

It is still another object of the present invention to provide a tool box having a cover and a number of trays which can be joined together without pivots.

It is still another object of the present invention to provide a tool box having a cover and a number of trays which can be fitted to each other without buckles.

For a better understanding of the present invention and objects thereof, a study of the detailed description of the embodiments described hereinafter should be made in relation to the accompanying drawings.

BRIEF DESCRIPTION OF DRAWINGS

The present invention will be described with reference to drawings showing two embodiments thereof, wherein.

DETAILED DESCRIPTION OF PREFERRED EMBODIMENT

Figure 1:
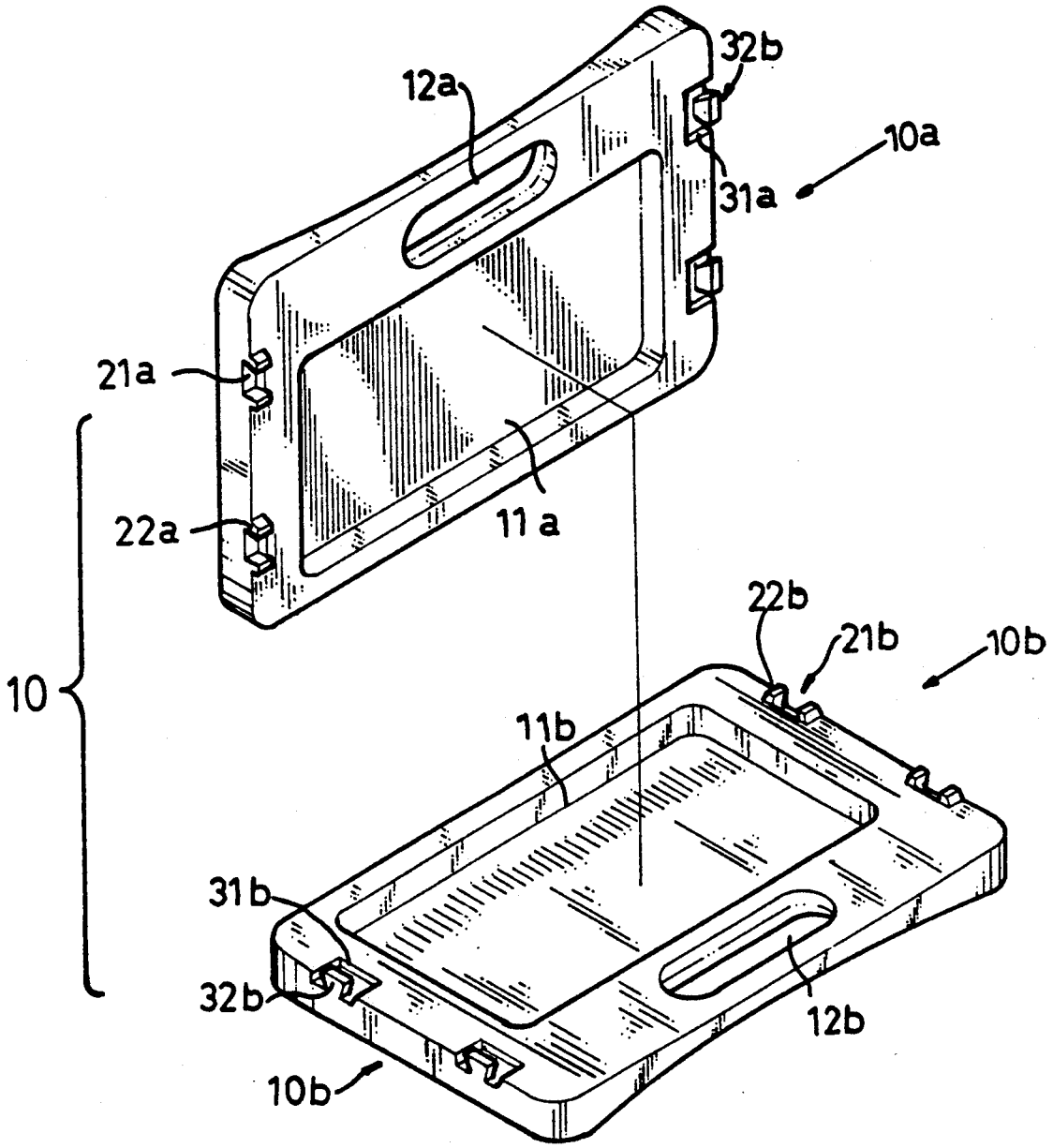
FIG. 1 is an exploded view of a tool box having two halves in accordance with a first embodiment of the present invention.

Initially referring to FIG. 1 of the drawings, a tool box 10 has two separate identical halves respectively referred to as the first half 10*a* and the second half 10*b*.

The first half 10*a* is substantially a plate with a sufficient thickness so that a cavity 11*a* is formed therein for containing tools (not shown).

Figure 6:
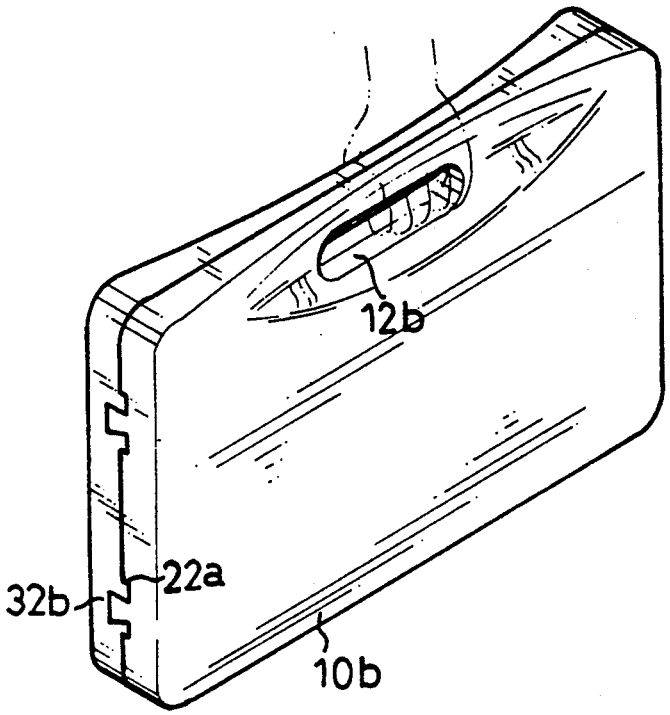
FIG. 6 is a perspective view of the tool box which has two halves which are locked to each other in accordance with a first embodiment of the present invention.

The first half 10*a* has a first margin, a second margin, a third margin and a fourth margin being parallel to the second margin. A slot 12*a* is parallelly formed in the first margin of the half 10*a*. Fingers (as shown in phantom lines in FIG. 6 of the drawings) are insertable through the slot 12*a* for picking up the tool box 10.

The first half 10*a* has two pairs of claws 22*a* formed on the four the margin thereof. Two recesses 21*a* are formed respectively between the pairs of claws 22*a*.

The first half 10*a* has two recesses 31*a* formed in the second margin thereof. Two anchors 32*a* are respectively formed in the recesses 31*a*.

Similar to the first half 10*a*, the second half 10*b* has two recesses 21*b*, two pairs of claws 22*b*, two recesses 31*b* and two anchors 32*b*.

Figure 2:
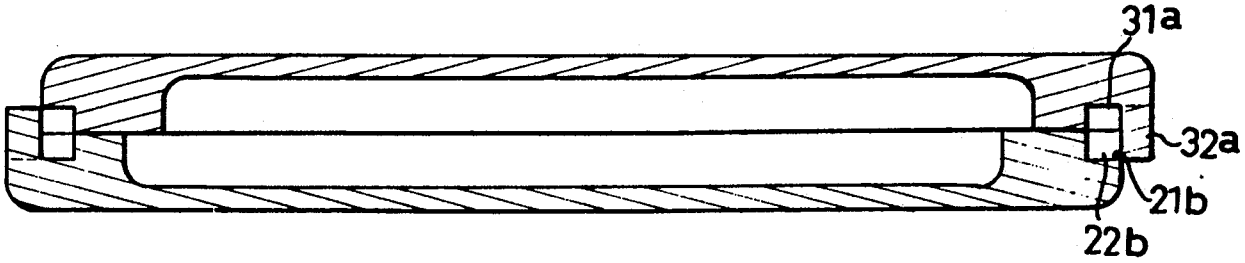
FIG. 2 is a cross-sectional view of the tool box which has two halves which are to be locked to each other in accordance with a first embodiment of the present invention.

Referring to FIG. 2 of the drawings, the first half 11*a* is sited on the second half 30 so that the cavity 11*a* faces the cavity 11*b*. The pairs of claws 22*a* are sited in the recesses 31*b* while the pairs of claws 22*b* are sited in the recesses 31*a*. The first half 10*a* is not aligned with the second half 10*b*.

Figure 3:
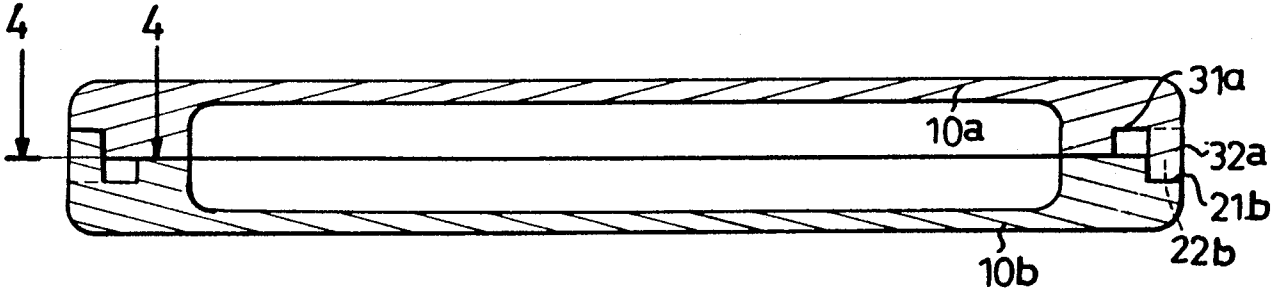
FIG. 3 is a view similar to FIG. 2, showing the two halves are locked to each other.
Figure 4:
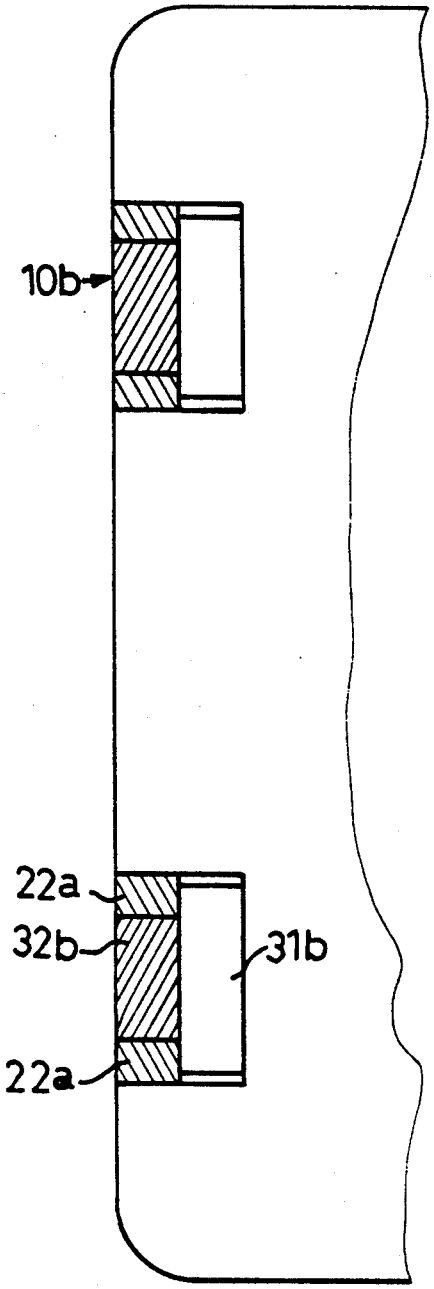
FIG. 4 is an enlarged cross-sectional view taken along line 4—4 in FIG. 3.

Referring to FIGS. 3 and 4 of the drawings, the first half 10*a* is slidable relative to the second half 10*b* in a direction perpendicular to the second and fourth margins thereof. The anchors 32*a* are sited between the pairs of claws 22*b* while the anchors 32*b* are sited between the pairs of claws 22*a*. The first half 10*a* is aligned with the second half 10*b*.

Figure 5:
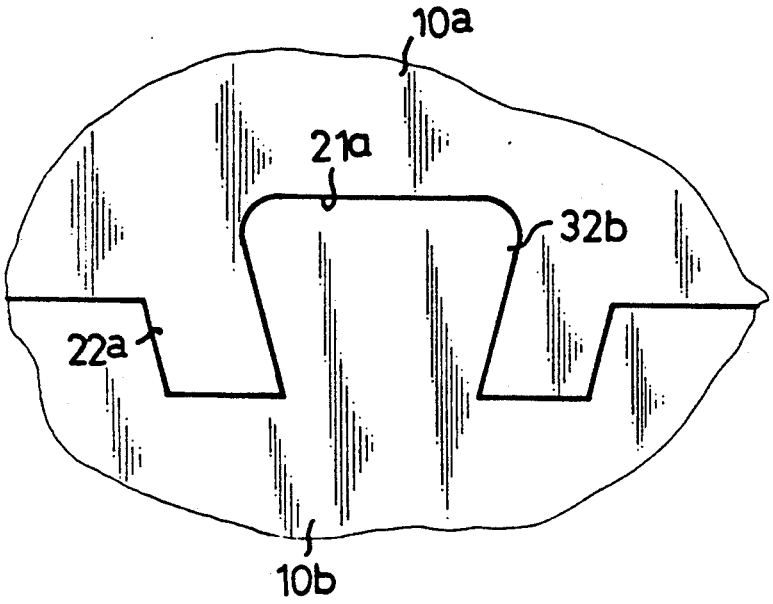
FIG. 5 is an enlarged side partial view of the tool box which has two halves which are locked to each other by means of a locking device in accordance with the first embodiment of the present invention.

Referring to FIG. 5 of the drawings, the anchors 32*b* project from the second half 10*b*. The portion on which each anchor 32*b* integrates with the second half 10*b* is referred to as the base of each anchor 32*b*. Each anchor 32*b* must have a portion having a width larger than that of the base thereof. Each pair of claws 22*a* forms a space matching the profile of each anchor 32*b*. Thus, the pairs of claws 22*a* cannot be disengaged from the anchors 32*b* in a direction perpendicular to the first and second halves 10*a* and 10*b* when the pairs of claws 22*a* are engaged with the anchors 32*b*.

Similarly, each anchor 32*a* must have a portion having a width larger than that of a base thereof. Each pair of claws 22*b* forms a space matching the profile of each anchor 32*a*. Thus, the pairs of claws 22*b* cannot be disengaged from the anchors 32*a* in a direction perpendicular to the first and second halves 10*a* and 10*b* when the pairs of claws 22*b* are engaged with the anchors 32*a*.

Figure 7:
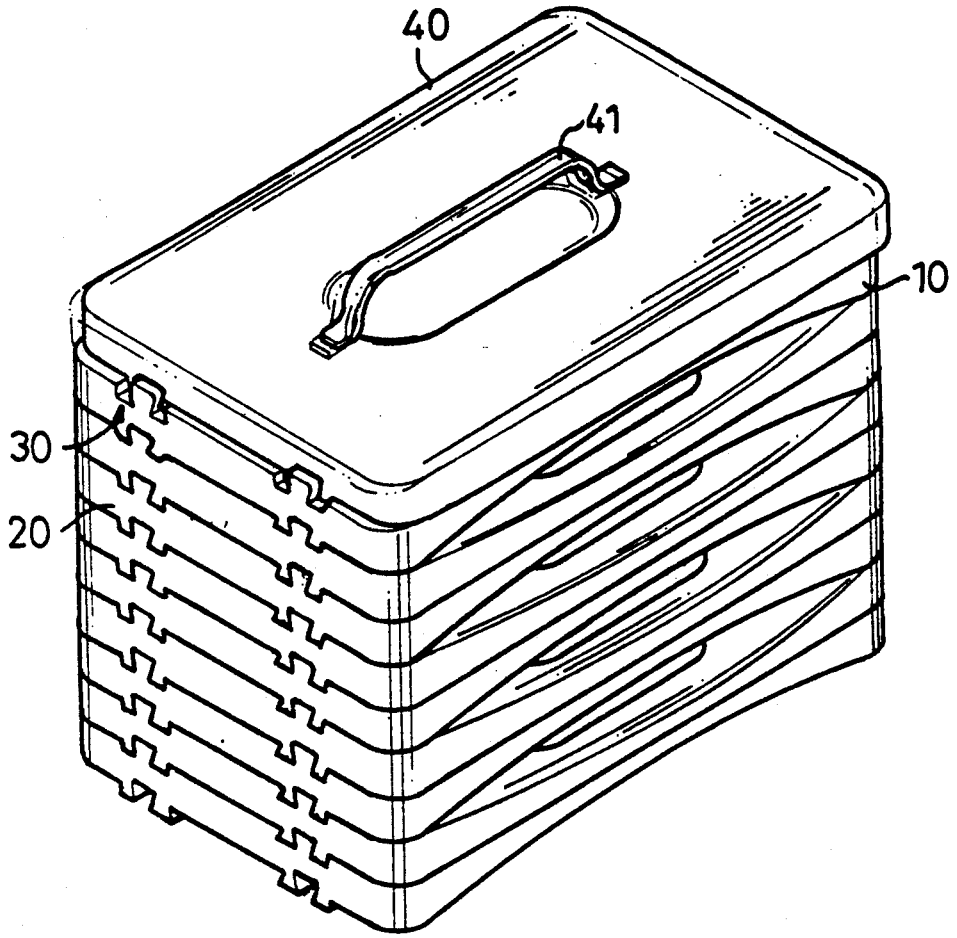
FIG. 7 is a perspective view of a tool box which has a cover and a number of trays in accordance with a second embodiment of the present invention.
Figure 8:
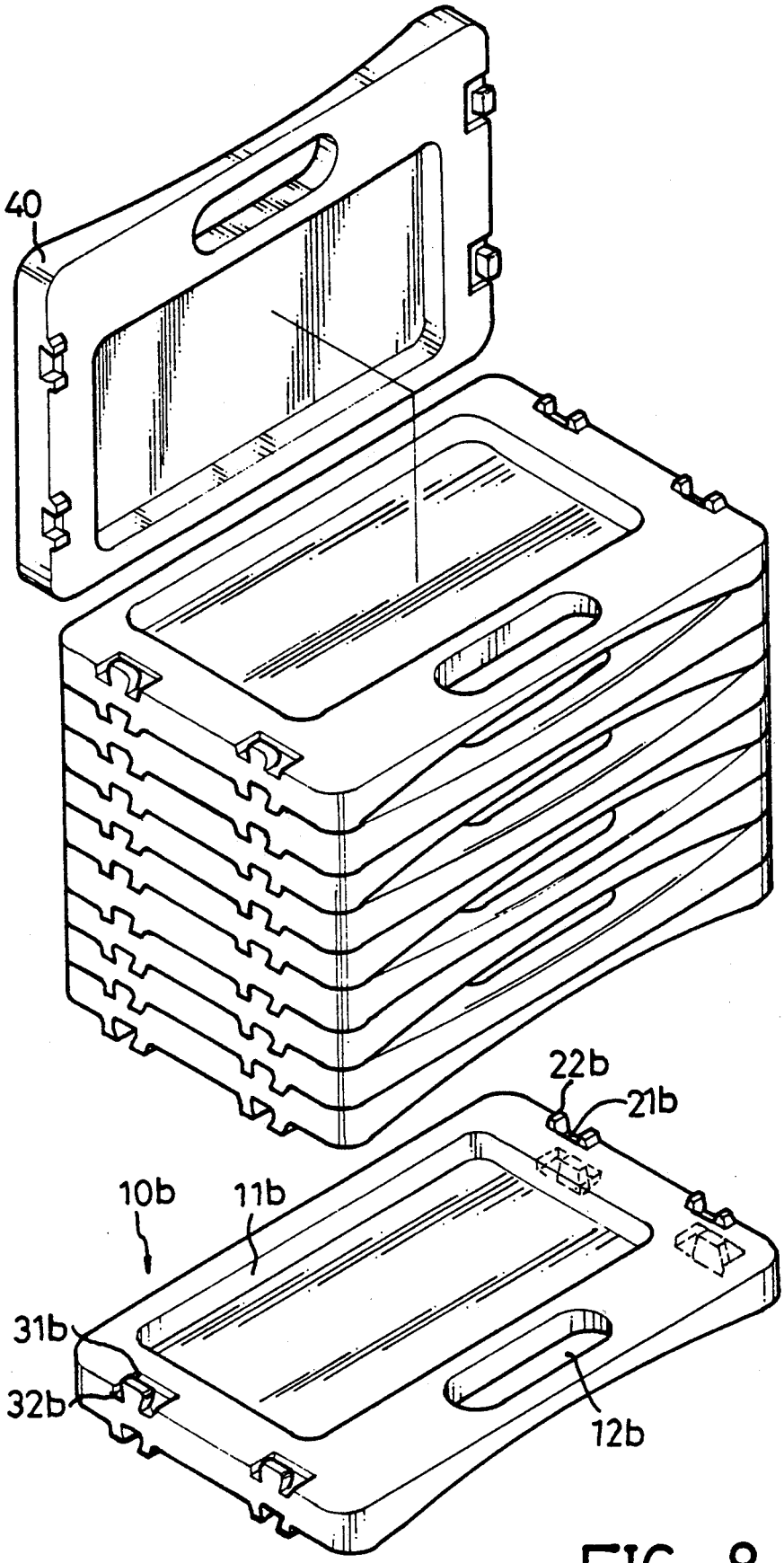
FIG. 8 is an exploded view of a tool box which has a cover and a number of trays in accordance with a second embodiment of the present invention.

Referring to. FIGS. 7 and 8 of the drawings, a tool box 10 in accordance with a second embodiment of the present invention has a cover 40 and a number of trays 50. The cover 40 is similar to the first half 10*a* of the tool box 10 in accordance with the first embodiment of the present invention. However, a grip 41 is formed on the cover 40. Each tray 50 has a first side on which two anchors (identical to the anchors 32*a*) and two pairs of claws (identical to the claws 22*a*) are formed and a second side on which two anchors (identical to the anchors 32*b*) and two pairs of claws (identical to the claws 22*b*) are formed. Obviously, the cover 40 can be fitted on top of the trays 50 and the trays 50 can be fitted to one another.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A tool box comprising:

a cover comprising at least one first recess formed therein, at least one anchor formed in said recess, at least one pair of claws formed thereon and at least one second recess formed between said pair of claws; and a number of trays each comprising at least one first recess formed in a first side thereof, at least one anchor formed in said first recess, at least one pair of claws formed on the first side thereof, at least one second recess formed between said pair of claws, at least one third recess formed in a second side thereof, at least one anchor formed in said third recess, at least one pair of claws formed on the second side thereof and at least one fourth recess formed between said pair of claws formed on the second side thereof;

said pair of claws formed on said cover being insertable in said first recess formed in one tray while said pair of claws formed on the first side of said tray being insertable in said first recess formed in said tray, and said cover then being slidable relative to said tray, so that said anchor and said pair of claws formed on said cover respectively engage with said pair of claws and said anchor formed on the first side of said tray, thereby restraining said cover from moving relative to said tray in a direction being perpendicular to said cover and said tray;

said anchor and said pair of claws formed on the second side of each tray being respectively engageable with said pair of claws and said anchor formed on the first side of the next tray, thereby restraining said trays from moving relative to one another in a direction being perpendicular to said trays.

2. A tool box in accordance with claim 1, wherein a grip is formed on a side of said cover opposite to a side on which said anchor and said pair of claws are formed.

* * * * *